US005392020A

United States Patent [19]

Chang

[11] Patent Number: 5,392,020

[45] Date of Patent: Feb. 21, 1995

[54] FLEXIBLE TRANSFORMER APPARATUS PARTICULARLY ADAPTED FOR HIGH VOLTAGE OPERATION

[76] Inventor: Kern K. N. Chang, 91 Adams Dr., Princeton, N.J. 08540

[21] Appl. No.: 990,132

[22] Filed: Dec. 14, 1992

[51] Int. Cl.[6] ..... H01F 27/28

[52] U.S. Cl. ..... 336/200; 336/182; 336/223; 336/225; 336/229

[58] Field of Search ..... 336/82, 200, 222, 223, 336/225, 229, 182

[56] References Cited

U.S. PATENT DOCUMENTS

| | | | |
|---|---|---|---|
| 2,937,351 | 5/1960 | Craig | 336/200 |
| 3,210,707 | 10/1962 | Constantakes | 336/200 |
| 3,614,554 | 10/1971 | Richardson et al. | 336/200 |
| 3,652,968 | 3/1972 | Johnston . | |
| 3,659,240 | 4/1972 | Learned et al. | 336/200 |
| 3,731,005 | 5/1973 | Shearman | 336/200 |
| 3,858,138 | 12/1974 | Gittleman et al. | 336/200 |
| 3,866,086 | 2/1975 | Miyoshi . | |
| 3,904,928 | 9/1975 | Sawada . | |
| 4,103,267 | 7/1978 | Olschewski . | |
| 4,204,263 | 5/1980 | Onoue . | |
| 4,229,786 | 10/1980 | Mitani . | |
| 4,253,231 | 3/1981 | Nouet | 336/200 |
| 4,263,096 | 4/1981 | Ohkawa . | |
| 4,266,269 | 5/1981 | Toba . | |
| 4,524,342 | 6/1985 | Mas . | |
| 4,635,019 | 1/1987 | Akachi . | |
| 4,639,706 | 1/1987 | Shimizu . | |
| 4,724,603 | 2/1988 | Blanpain . | |
| 5,070,317 | 12/1991 | Bhagat | 336/200 |
| 5,079,532 | 1/1992 | Bonanos . | |
| 5,093,613 | 3/1992 | Diepenmaat . | |
| 5,122,947 | 6/1992 | Hishiki . | |

FOREIGN PATENT DOCUMENTS

| | | | |
|---|---|---|---|
| 143116 | 9/1948 | Australia | 336/200 |

*Primary Examiner*—Thomas J. Kozma
*Attorney, Agent, or Firm*—Arthur L. Plevy

[57] ABSTRACT

A transformer secondary winding comprises a laminated structure which includes first and second outer sheets fabricated from an insulator material, sandwiched between the outer sheets is a thin flexible sheet of a magnetizable material. The first and second outer sheets each have a parallel conductive line pattern on a surface thereof. Selected ends of the lines on the first sheet are connected to the selected ends of the lines on the second sheet in such a manner as to provide a coiled pattern between the sheets, which coiled pattern encircles the central magnetizable sheet. The above laminated configuration can be flexed or rolled into a circular configuration to form a transformer secondary winding. The circular secondary windings are concentrically positioned about a first primary cylinder fabricated from an insulator sheet having parallel conductor elements or lines arranged on a surface thereof. A second outer primary cylinder surrounds the secondary windings at the outer periphery and is fabricated from an insulator sheet having a conductive line pattern on a surface. The conductive lines of the first and second cylinders are connected to form a primary winding about the secondary windings to provide many different transformer configurations.

21 Claims, 5 Drawing Sheets

FLEXIBLE TRANSFORMER APPARATUS PARTICULARLY ADAPTED FOR HIGH VOLTAGE OPERATION

The subject matter of this invention is in part contained in a Disclosure Document No. 317330 filed with the United States Patent Office on Sep. 21, 1992.

1. Field of the Invention

This invention relates to a transformer apparatus in general and more particularly to a flexible transformer apparatus which is particularly adapted for use as a flyback transformer as those employed in television sets.

2. Background of the Invention

Transformers are utilized in a wide variety of applications. A flyback transformer is a device which is used to generate a high voltage as is employed in TV receivers and oscilloscopes for biasing the cathode ray tube or CRT. These transformers produce relatively large voltages at relatively small currents. The ability to produce a large voltage resides in the number of turns that are associated with the secondary winding, as compared to the number of turns associated with the primary winding. As is well known, the turns of the secondary, as compared to the turns of the primary, determine the voltage step up of the transformer. Such flyback transformers can operate as tuned transformers which consist of a primary winding and a number of secondary windings which are tuned or resonated. These secondary windings are wound on the same bobbin and each adjacent secondary windings are connected in series through a diode. This type of flyback transformer is referred to as a tuning flyback transformer where a horizontal output pulse or flyback pulse is applied as an input pulse to the tuned primary winding.

An odd order higher harmonic wave of a fundamental frequency applied to the primary winding, such as for example, the third harmonic is tuned and provided at the secondary winding, based on the distributed capacity of the secondary winding which is small. In this manner the transformer provides a high voltage at the output of the secondary winding. As indicated, such transformers are well known. Many such transformers utilize a toroid or core of a donut shape fabricated from a magnetic material of a given permeability, which core can be wound with wire. In the ideal core, the winding represents a uniform current sheath circulating about the core in appropriate planes. In this ideal case, the magnetic field is entirely confined within the core, the magnetic field lines are concentric circles and each links with the entire current volume. Such a uniform distributed current flow around the core results in a leakage free configuration. However, this is not the case in practical applications.

Other transformers utilize cores which are square shaped having multiple legs. Both the primary and secondary windings rest on one leg. Thus the current distribution around the core is by no means uniform, leading to a certain amount of leakage flux. Such conventional transformer features typically provide leakage flux in the order of 6%, a frequency response in the ranges between 30 Hz and 28 kHz. The efficiency of such transformers is on the order of 85% with the voltage regulation being about 1.5–2 megohms. The size, both of the toroid and in these E-shaped transformers is bulky and the material is not fully or optimumly utilized. The winding employs solid round wires and coupling to the core is not really ideal, leading to local leakage.

As the prior art can ascertain, when such transformers are used as flyback transformers they can provide relatively high voltages ranging from 7–28 KV and higher. In any event, the high voltage regulation is poor. If the high voltage regulation is poor, the reproduced picture of a TV receiver can suffer deterioration. The prior art was aware of this, and provided certain solutions involving using multi-layer winding flyback transformers which were designed to operate to provide more stable high voltage regulation. The multilayer winding flyback transformer has been described in many U.S. patents. The problems with these transformers relate to short circuit operation where if a short circuit occurs on a secondary winding, or if discharge is caused within the picture tube, the diodes associated with such transformers are subjected to high reverse voltages which can operate to destroy these diodes.

The prior art is replete with a number of patents which describe various flyback transformers. See U.S. Pat. No. 3,866,086 entitled "Flyback Transformer Apparatus" issued on Feb. 11, 1975 to Miyoshi, et al. This describes a flyback transformer where the primary winding is inductively coupled with the high voltage side winding portion of the first secondary winding. The transformer provides an output impedance which is reduced and a focusing voltage which is relatively regulated.

U.S. Pat. No. 3,904,928 entitled "Flyback Transformer" issued on Sep. 9, 1975 to Sawada, et al. This patent describes a flyback transformer which utilizes a magnetic core with secondary windings wound around the core and a primary winding. In this transformer the secondary winding is divided into a plurality of winding units which are alternately connected with the same number of rectifying elements such as diodes in series. The structure is such that a relatively compact device can be accommodated.

U.S. Pat. No. 4,204,263 entitled "Flyback Transformer" issued on May 20, 1983 to Onoue. This patent describes a flyback transformer having a plurality of secondary windings wound about a magnetic core. The secondary windings are divided into a plurality of coil units and are alternately connected in series with a plurality of rectifying diodes. The coil units are wound around individual layer bobbins where the bobbins are assembled in layers and fitted alternately with the outermost bobbin being mounted with a support in which a plurality of diodes are fixed. The structure purports to be relatively compact.

U.S. Pat. No. 4,229,786 entitled "Flyback Transformer With A Low Ringing Ratio" issued on Oct. 21, 1980 to Mitani, et al. This patent describes a flyback transformer having a tertiary winding for obtaining a secondary power source which is wound in a position where the coupling with the primary winding is weak and where the winding interlinks the leakage flux of the secondary winding with the primary winding. The output of the tertiary winding is rectified during the horizontal scanning period of a television receiver. In this manner the wave crest of the ringing is made smaller regardless of the pulse which is applied to the secondary winding.

U.S. Pat. No. 4,266,269 entitled "Flyback Transformer" issued on May 5, 1981 to Toba. This describes a multilayer flyback transformer which has five cylindrical bobbins which are concentrically arranged. A magnetic core is inserted in the first or innermost bobbin and a primary winding is wound in layers on the outer periphery of the bobbin. Diodes are connected between the secondary windings and a capacitor is formed between the cathode of the diode and the anode of another diode. In this manner the transformer is capable of providing high voltage operation in a relatively compact design.

U.S. Pat. No. 4,639,706 entitled "Flyback Transformer" issued on Jan. 27, 1986 to Shimizua. This patent describes a flyback transformer where a tertiary coil is wound on an auxiliary bobbin which is separately provided. The bobbin is inserted on a low tension coil bobbin for the primary coil which serves to insulate the tertiary coil from the primary coil.

U.S. Pat. No. 5,122,947 entitled "Flyback Transformer Having Coil Arrangement Capable of Reducing Leakage of Magnetic Hux" issued on Jun. 16, 1992 to Hishiki. This patent describes a flyback transformer which uses a magnetic core assembly formed by joining a pair of first and second U-shaped core halves each having two leg portions with end surfaces respectively joined in a mutually abutting configuration. There are gap spacers interposed between the first and second core parts and a coil is wound about the core parts. The resulting transformer has an output winding, which is a secondary, which can be divided into at least two windings to provide separate flux paths.

As one can ascertain, apart from the above-noted patents there exists many more patents which involve various transformer configurations and which attempt to reduce the size of the transformer while making the transformers more efficient. For examples of such prior art, reference is made to U.S. Pat. No. 4,103,267 issued on Jul. 25, 1978 to Olschewski entitled "Hybrid Transformer Device". This patent describes a transformer mounted on a ceramic substrate having a plurality of planar conductors formed on a surface of the substrate. The conductors extend radially from an imaginary point on the substrate. A layer of dielectric material is formed over the major portions of each of the conductors to form a ring of dielectric material to which is ferrite toroidal core is secured. The core is precoated with an insulating material prior to adhesively being secured to the dielectric ring. A plurality of wire conductors are wire bonded at each end to the exposed ends of the metal conductors on a substrate to form a printed circuit transformer.

U.S. Pat. No. 4,524,342 issued on Jun. 18, 1985 to Joseph Mas and is entitled "Toroidal Core Electromagnetic Device". This patent describes an electromagnetic device which can include a transformer and has a magnetic core and a segmented electrical winding. The core has an enclosed trunk defining a central opening. At least three coil sections of the electrical winding encircle the trunk and are circumferentially spaced about the periphery of the core.

U.S. Pat. No. 4,724,603 issued on Feb. 16, 1988 to Blanpain et al. and is entitled "Process for Producing a Toroidal Winding of Small Dimensions and Optimum Geometry". This patent describes an process to produce a small toroid. Windings having turns which are radial with respect to a cylinder are employed. The cylinder is provided with slots arranged along the axes of an internal and external cylinder. Hairpin shaped conductive wires are introduced into these slots and welded to one another.

As one can also ascertain, there are many other patents which essentially describe improved magnetic circuits used for small compact transformers as well as for flyback transformers.

The present invention describes a flexible transformer which operates without conventional wires and is capable of improved operation in providing a reduced leakage flux, a higher frequency response, improved efficiency, improved voltage regulation while providing a compact and efficient design.

SUMMARY OF THE INVENTION

A transformer secondary winding comprising a flexible laminated member, comprising a first planar sheet member having a first plurality of parallel conductive lines on a surface thereof, a second planar sheet member having a second plurality of parallel conductive lines of a surface thereof, a central planar sheet member fabricated from a magnetizable material interposed between said first and second planar members and means for connecting ends of said first and second parallel lines to one another to form a coiled pattern directed about said central member to enable any current flowing in said coiled pattern to magnetize said central planar sheet according to said current flow.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE FIGURES

Figure 1:
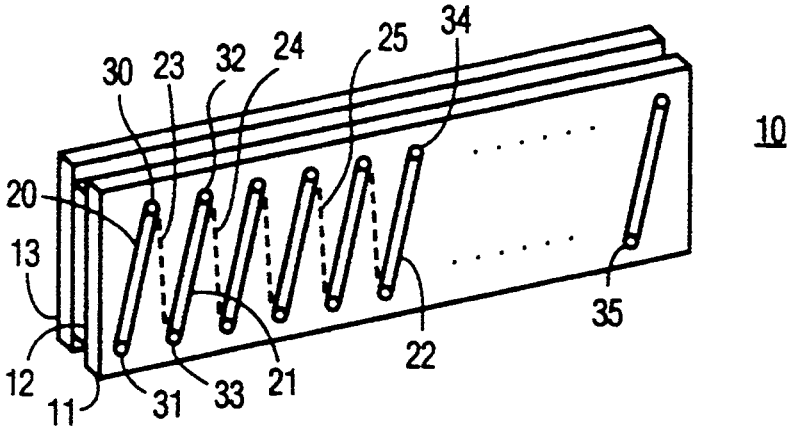
FIG. 1 is a perspective plan view of a composite laminar flexible transformer element according to this invention.

Referring to FIG. 1 there is shown a composite planar member 10 which essentially constitutes the main aspect of a secondary winding structure used with the present transformer. The composite transformer winding 10 comprises lamina, thin sheets, or insulator tapes accommodating conductive parallel line patterns and where a magnetizable sheet is sandwiched between two conductive line carrier sheets or tapes. The member 10 consists of three sheets and is shown in FIG. 1 in a laminated construction. The three sheets are extremely thin and the entire composite member 10 can be rolled or otherwise bent and as such is a flexible member. The utilization of the composite laminated member 10 will enable one to construct various transformer configurations as those of a closed-ring configuration or a spiral configuration.

As seen in FIG. 1, a first planar member 11 is fabricated from an insulating material which, for example, may be a suitable paper such as a Kapton paper or some other paper or plastic which is normally used in the integrated circuit field or for with transformers. The insulating material must be able to accommodate metal deposition or evaporation. Disposed upon a top surface of the sheet 11 is a series of conductor elements or conductive lines such as 20, 21, 22 and so on. There are a plurality of such conductive lines 20, 21 . . . etc., each of which is parallel to a adjacent ones. The conductor line pattern is directed across the top surface of the insulating sheet 11. Each conductor is formed from a suitable conducting metal such as copper, gold, silver, which is evaporated on the surface of the insulating sheet 11 by conventional evaporation techniques using photolithographic procedures similar to those used in the formation of integrated circuits. In this manner a conductive metal can be evaporated or otherwise positioned on the top surface of the Kapton sheet 11 to form the conductor pattern as shown in FIG. 1. Each conductor may be at a slight angle with respect to the vertical or may be relatively vertical. The conductors are spaced apart by a predetermined fixed distance. The distance between conductors can be extremely small as less than 2.0 mils. The insulator sheet 11, as indicated, is relatively thin and may be formed from a paper or other plastic or insulating material having a thickness of approximately 1 mil. The width of a conductor is typically about 5 mils or less.

While suitable metal conductors, such as 20 and 21, can be applied to such substrates by evaporation techniques or by RF sputtering, they can also be deposited as a paste-like organic, metal glass mixture which are referred to as inks or pastes and are utilized in the thick film IC field. In this manner such conductors are applied as a paste-like organic metal glass mixture to a suitable paper or flexible plastic substrate. The metals used for thick film conductors are noble metals such as platinum, palladium, gold, silver and various combinations and alloys of these metals. To control adhesion, solderability and chemical stability, the glass/metal ratio, particle size and shape of the metals and various components are all important variables. Thus, it is well known how to impose conductor patterns on a paper or a flexible plastic substrate to form the planar member 11.

Figure 5:
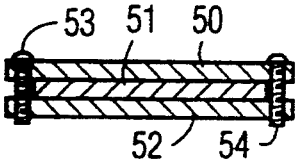
FIG. 5 is a cross-sectional view showing an arrangement of the planar transformer configuration according to this invention.

Also shown in FIG. 1 is a planar member 13 which essentially is of the same thickness and material as member 11 and which includes an alternate series of parallel conductors or conductive lines, such as 23, 24 and 25, shown in dashed line in FIG. 1. The surface configurations of planar member 11 and planar member 13 are shown respectively in FIGS. 2 and 3. Each of the conductor elements, such as 20 and 21 on sheet 11, are connected to an associated conductor element on the back planar sheet member 13, such as conductor elements 23 and 24. This can be accomplished in a number of ways. Shown in FIG. 1 are apertures 30, 33, 32, 34 and 35 and so on. These apertures are via apertures and enable the top terminal 30, for example, of conductor 20 to be connected to the top terminal of conductor 23 on substrate 13 via the holes 30 and 30*b* as shown. In this manner one forms an alternating pattern of connected conductor lines which essentially serve to surround the center member 12. The connected conductive lines form a coil of a zig-zag pattern disposed about the center planar magnetizable sheet 12. The center member 12 is formed from a magnetizable material and essentially is a magnetic sheet. The center member 12 may consist of a soft iron sheet bounded on both sides by the insulator sheets 11 and 13. The via holes as 30, which connect the conductors on the planar sheet 11 to the conductors on planar sheet 13 are not directed through the soft iron central layer 12. This is particularly shown in FIG. 5 where reference numeral 50 depicts a layer such as layer 13, reference numeral 52 depicts a layer such as layer 11 with the layers separated by the magnetizable layer 51. There are conductors 53 and 54 directed through suitable apertures from the layer 50 to the layer 52 without in any manner touching the layer 51. It is of course known that other techniques for joining the members can be implemented as will be explained.

As one can see from FIG. 1, the basic transformer secondary winding configuration consists of a composite laminar structure which is flexible, consisting of a first planar sheet member 11 having parallel conductors or conductive lines on a top surface thereof. A second planar member 13 has corresponding conductor elements on the top surface thereof and selected end points of the conductive lines on member 11 are joined with end points of the conductive lines on member 13 to form a wireless transformer winding arrangement with the conductors interlaced, insulated and alternating about the magnetic material or magnetic central sheet 12. The connected conductive lines form a zig-zag coiled pattern and operate and function as "windings" about the "core" as sheet 12. The outer planar sheet members 11 and 13 are referred to as current sheets because this is where the current is directed, while the inner magnetic member 12 is referred to as a magnetic sheet. As one can ascertain, the structure alternates from the planar member 11 to the planar member 13 via the interconnected conductive lines, as 20, 23, 21, 24 and so on. In this manner the line structures are associated with the central magnetizable material sheet 12 and thus form a coil about the center sheet 12.

While the magnetic planar sheet 12 can be fabricated from a soft iron which can be flattened by many conventional techniques to form a sheet of magnetic material, other materials can be utilized as well. For example, there is a product which is manufactured by Allied Corporation of Parsippany, N.J. sold under the tradename of Metglas. This product is an amorphous alloy ribbon which has magnetic capabilities and a relatively large tensile strength. The material can be bent or otherwise formed and the amorphous or non-crystalline atomic structure of the alloys give them unique electromagnetic properties. The alloy can be employed in pulse transformers, magnetic amplifiers, power transformers and current transducers and other devices requiring a square loop high saturation material. As indicated, such materials are available from other sources as well and can be utilized to form the magnetic sheet or central member 12. The sheets 11, 12 and 13 are held in place due to the connections between the conductive line patterns on outer sheets 11 and 13. The sheets can be otherwise secured together.

Figure 2:
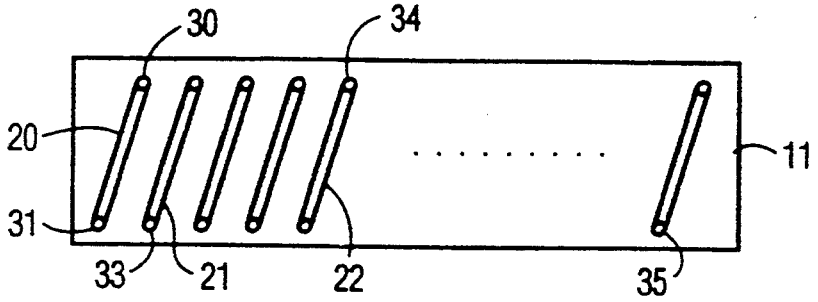
FIG. 2 is a top plan view of a top planar member utilized in this invention.
Figure 3:
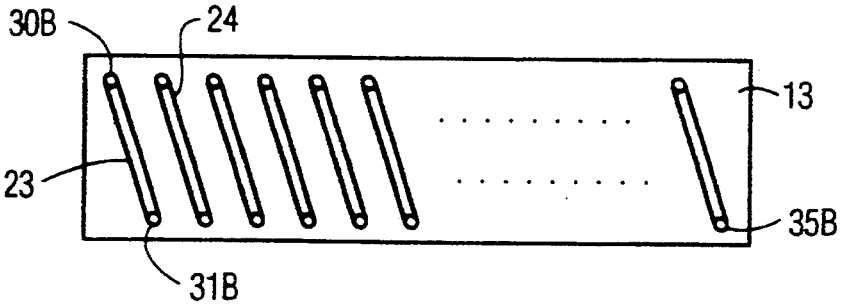
FIG. 3 is a top plan view of a bottom planar member utilized in this invention.

FIGS. 2 and 3 show planar members 11 and 13 in a top plan view, showing the parallel conductor line patterns.

Figure 4:
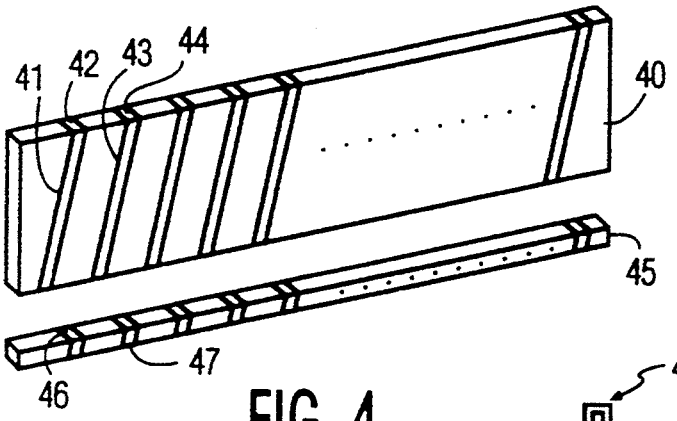
FIG. 4 is a perspective view of an alternate embodiment showing a planar configuration which can be employed with this invention.
Figure 6:
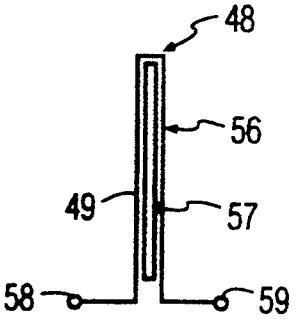
FIG. 6 is a cross-sectional view depicting a method of connecting planar members according to this invention.

Referring to FIG. 4, there is shown an alternate way of joining such planar sheet members. As shown in FIG. 4, planar sheet member 40 can constitute the member 11 or 13 of FIG. 1. Essentially member 40 has conductors or conductive parallel lines, as 41 and 43, directed along the top surface or other surface and which members terminate in land areas 42 and 44 at the thin edge. These land areas are then bridged or coupled together by means of contact members 46 and 47 which are disposed as a top sheet or cap structure 45. In this manner the cap 45 operates to provide contact between conductors on sheets as 11 and 13 having the configuration shown in FIG. 4. This particular technique is shown in more detail in FIG. 6. FIG. 6 shows a first member 56 and a second member 49 which sandwiches the central magnetic member 57. The sheet members 49 and 56 each have a suitable pattern of parallel conductive lines on a surface. Reference numeral 48 depicts the bridge formed by the bridging connector which operates to connect the top ends of selected conductors. Another bridge as **48*b* (FIG. 6) would connect the bottom ends or terminals. Contacts 58 and 59 are brought out from either end of the conductors as desired. Thus, in the configuration shown in 4 and 6, the members, as 45, act as a lid and have bridging contacts to enable the planar members, as 11 and 13**, to be connected together by means of caps or bridging contacts without the use of via holes. It should become apparent to those skilled in the art that other techniques for connecting the sheets together can be employed as well.

Figure 7:
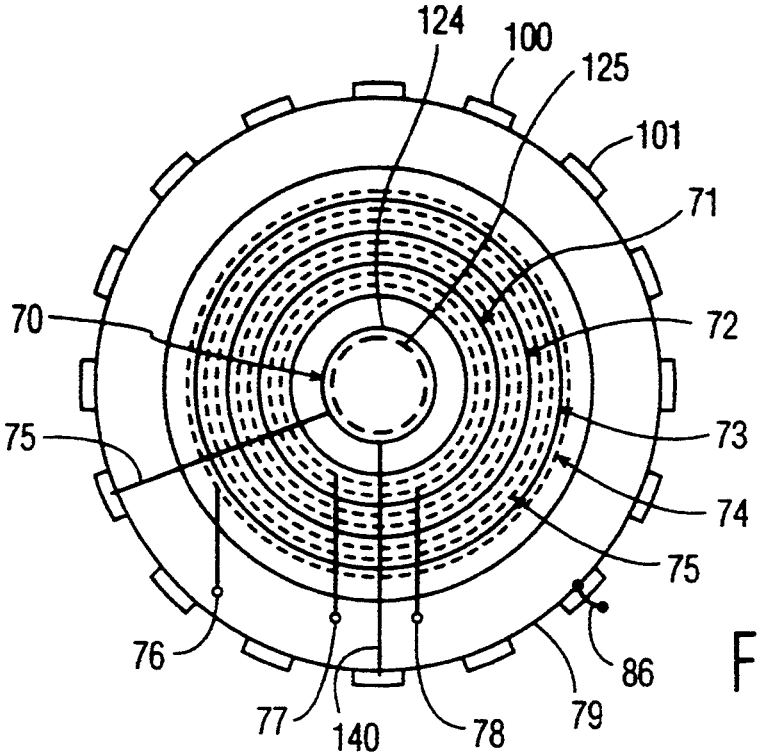
FIG. 7 is a top plan view showing an annular or closed ring configuration of a transformer fabricated according to this invention.

Referring to FIG. 7, there is shown one type of transformer configuration which can be implemented using the secondary winding structures depicted in FIGS. 1 to 6 above. In the transformer structure of FIG. 7 there is shown a plurality of secondary windings, each of which is formed from a planar composite sheet, as sheet 10 of FIG. 1 and of appropriate length and which, surrounds a central or center primary cylinder 70. The separate secondary sheets are positioned about the primary cylinder 70 in concentric circles. Each of the dark lines as 71, 72 and 73 represent the magnetic sheets or the planar sheets as 12, while the dashed lines represent the outer current sheets such as sheets 11 and 13. It is of course understood that in order to avoid electrical shorts, the respective sheets can be insulated by covering the exposed surfaces with paper or other insulators. In a similar manner the sheets can be arranged, as shown in FIG. 7, and separated by placing a suitable shellac or other insulating material over the conductive line pattern.

Figure 9:
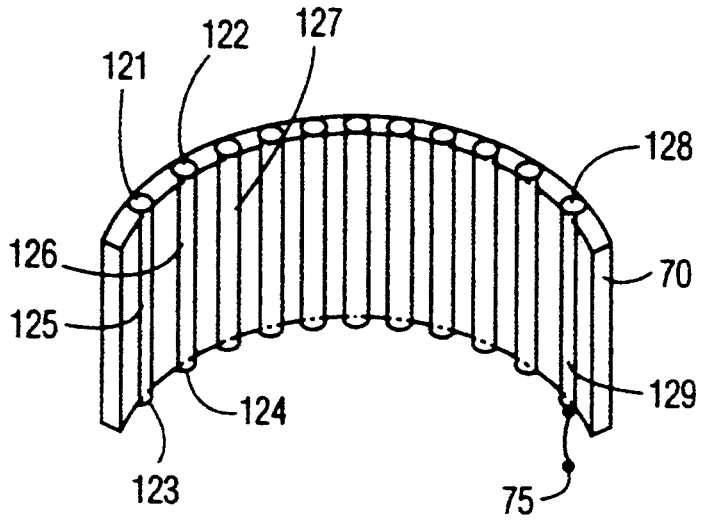
FIG. 9 is a perspective plan view of a flexible primary planar sheet used as an inner cylindrical primary structure.

Thus in the transformer arrangement of FIG. 7 the secondary windings are planar sheets as those shown in FIGS. 1 to 6 each arranged in concentric circles about a primary cylinder 70. Each separate secondary windings sheet has two terminals as 77 and 78 which are available via suitable leads or wires. The primary cylinder 70 is comprised of a flexible sheet such as sheet 70 shown in FIG. 9. The insulator sheet 70 of FIG. 9 is fabricated from a suitable paper and has deposited on the surface a plurality of parallel conductive lines as 125, 126, 127 and 129. The conductive lines are shown as vertically oriented but can be at slight angles and are parallel to each other. The conductor lines terminate in top and bottom land areas, as land areas 121 and 123 for conductor 125, and top land area 122 and bottom land area 124 for conductor 126 and so on. Each conductor of the plurality has such land areas. The flexible primary sheet is bent or flexed into a circular configuration and placed in the center of a secondary winding arrangement to form one portion of the primary winding. As shown in FIG. 7, the conductors 124 and 125, are arranged on the inside of the concentric cylindrical primary structure 70. The conductive lines can also be arranged on the outside as well.

Figure 10:
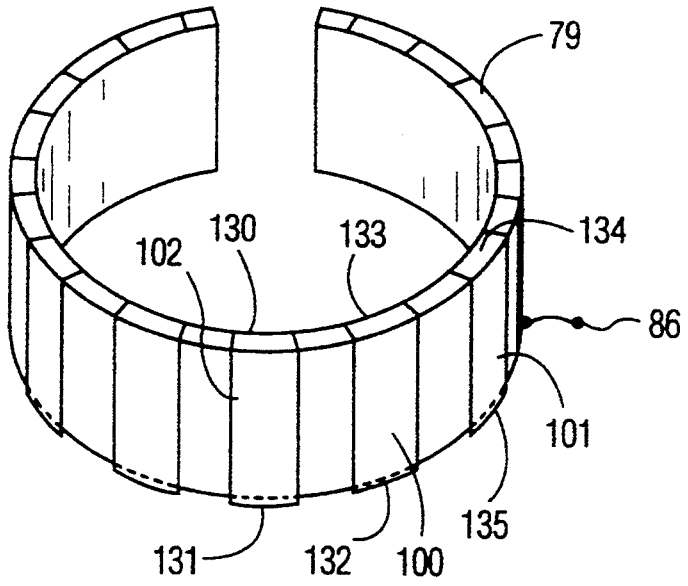
FIG. 10 is a perspective plan view of a flexible primary planar sheet used as an outer cylindrical primary structure.

A second component of the primary winding consists in an outer concentric circular planar member 79 which again is fabricated from an insulator sheet and has deposited on a surface thereof larger or wider conductive areas as 100 and 101. The number of conductive lines or areas on the outer primary cylindrical structure is the same as the number of conductive lines on the inner cylindrical structure 70. As shown in FIG. 10, the outer primary member 79 has parallel conductive lines 100, 101 and 102 each having land areas as 130 and 131 associated with conductor 102, land areas 132 and 133 associated with conductor 101 and so on.

As will be explained, the outer primary cylindrical structure 79 is connected to the inner primary cylindrical structure 70 by means of suitable conductors which may be located on cap members. The conductive line patterns are connected together by means of conductive paths to form a continuous coiled primary winding which overlays the secondary winding. Conductors are directed from a inner primary conductive line as 127 on member 70 to an outer primary conductive line as conductor 101 on the outer ring 79. This is shown schematically in FIG. 7 by referring to conductor 140.

Figure 11:
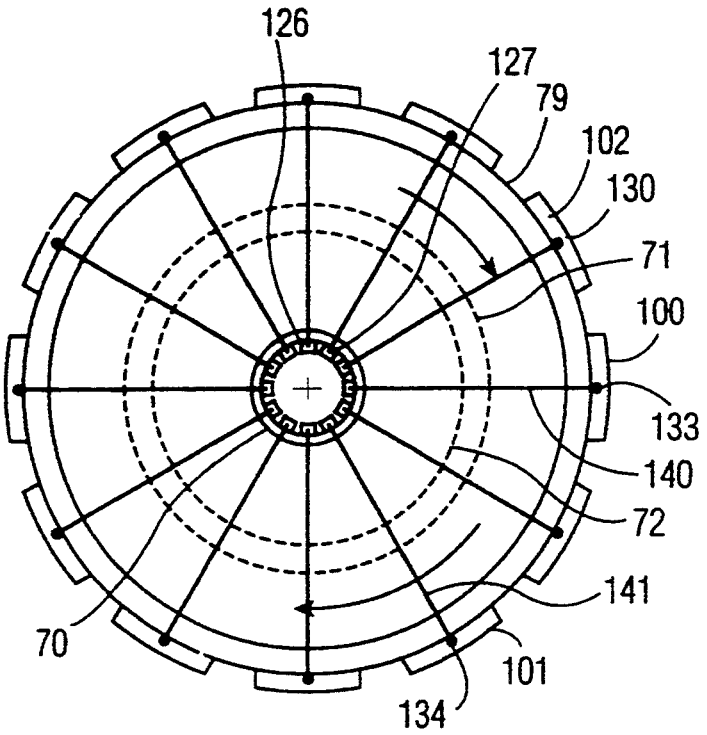
FIG. 11 is a top view depicting the connection between the inner and outer primary structures.

Referring to FIG. 11 the inner primary cylinder 70 and the outer primary cylinder 79 are shown with a secondary configuration shown in dashed lines positioned concentrically between the primary cylinders. The arrows in the figure show the direction of flux flow through the secondary. Current flows in the primary conductors, as for example in the primary center cylinder 70, into the paper as shown by the cross at the center. Current flows in the outer primary conductor, as conductors 100, 102 and 101, out from the paper. Hence primary current flows into the conductors of the central conductor 70 in a direction in the paper and out from the paper in conductors as 100, 101, 102. The conductors are arranged as follows: Conductor 102 with top terminal 130 is connected to an inner conductor of cylinder 70 at the top terminal of the inner conductor. The bottom terminal of the inner conductor is then connected to a suitable bottom terminal for example of conductor 100 where the top terminal of conductor 100, as terminal 133, is connected to the top terminal of the next conductor in the line with the bottom terminal of the next conductor connected to the bottom terminal of conductor 101 and so on. This, as one will understand, creates a coil pattern where the wires or connectors, as 140 and 141 for example, are directed about the secondary configuration as for example secondary windings 71, 72, 73 of FIG. 7. In this manner, a suitable electric field is induced to enable current flow in the primary winding to cause in current flow in the secondary windings. It is of course understood that appropriate terminals such as terminal 75 associated with the inner cylinder 70 and terminal 86 associated with the outer cylinder 79 provide the input terminals for the primary winding.

Figure 12:
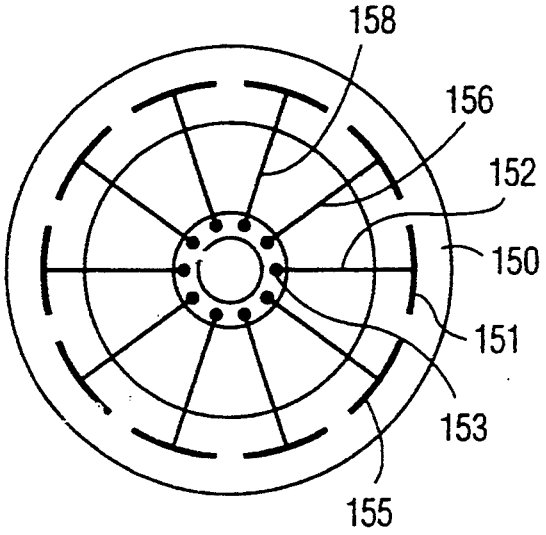
FIG. 12 is a top plan view of a primary cap connector.
Figure 13:
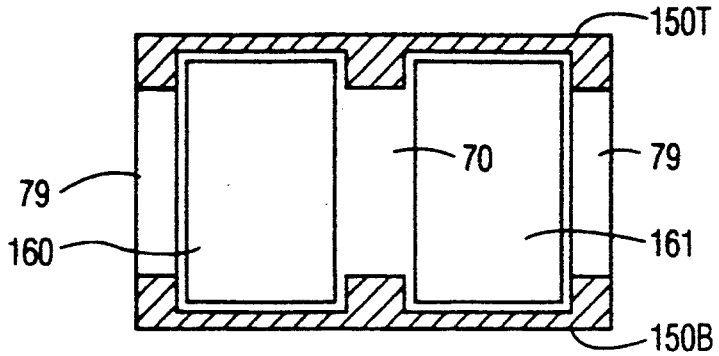
FIG. 13 is a cross-sectional view of a transformer with top and bottom primary cap connectors.

Referring to FIG. 12 there is shown a cap which may be fabricated from a suitable insulative material such as a ceramic, paper, cardboard or other material. Formed on the bottom side of the cap, are a series of conductive land areas which are positioned near the outer peripheral of the cap, as conductors 152 and 155. Each outer land area is connected to an inner land or terminal area. Thus, inner conductive area 153 is connected to outer conductive area 151 by means of the conductive line 152. Each outer conductive area is connected to an inner conductive area by a radial conductive lines as 152, 156, 158 and so on. The cap 150 constitutes a connection cap or a connector which connects the outer or top terminals of primary cylinder 79 to the outer or top terminals of primary cylinder 70. In a similar manner, a bottom cap, which is configured or cap 150, constitutes another conductive pattern which operates to connect alternate bottom conductors of the inner and outer primary cylinders to form an alternating or coiled pattern. The cap members are shown in FIG. 13 where a top cap 150T, and a bottom cap 150B are shown positioned with respect to the inner and outer primary cylinders 70 and 79. The caps, as indicated, connect the top land areas of the outer primary cylinder 79 to the appropriate land areas of the inner primary cylinder 70. Reference numerals 160 and 161, indicate the positions of the secondary winding sheets as shown in FIG. 7 or FIG. 8.

Figure 8:
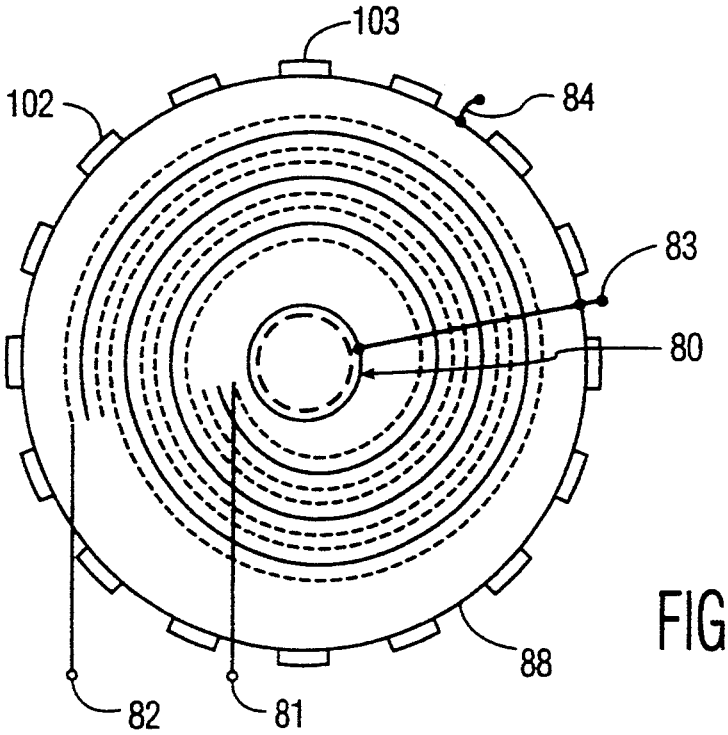
FIG. 8 is a top view showing a spiral transformer configuration fabricated according to this invention.

In FIG. 8, there is shown a spiral configuration where one elongated member, as member 10 of FIG. 1, is arranged in a spiral coiled pattern to form a secondary which is directed around a primary cylindrical member 80 associated with a primary outer cylinder 88. The primary has input terminals 83 and 84. The primary winding is structured exactly as the above-described primary consisting of primary cylinders 70 and 79 and is interconnected in the same manner, including caps as shown in FIG. 12 and FIG. 13, for example or by wires.

Figure 14:
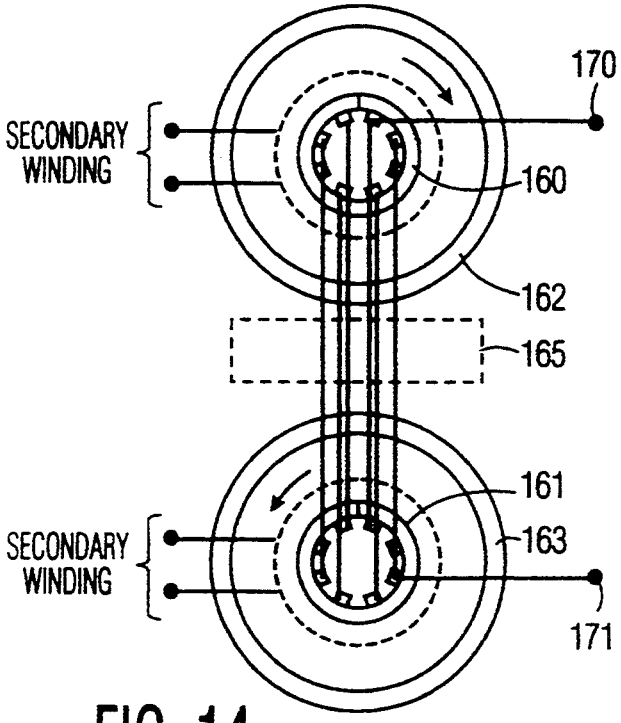
FIG. 14 is a schematic of an alternate transformer configuration.

Referring to FIG. 14 there is shown an entirely different transformer configuration which essentially is implemented from the flexible conductive planar sheets as described above. As seen in the top view of FIG. 14, there is shown a primary cylinder 160 and a primary cylinder 161. Each of the cylinders as 160 and 161 has the configuration shown in FIG. 9 and essentially each consists of a planar flexible sheet, as sheet 70 of FIG. 9, having a plurality of parallel conductive lines, as conductors 125, 126 and 127. Each of the primary cylinders are surrounded by a suitable secondary structure, such as the secondary structure shown in FIG. 7 or the secondary structure shown in FIG. 8. The conductive lines of each cylinder, are connected together by means of wires or by means of top and bottom caps to form a coil or a primary winding where current flows in the directions of the arrows shown. The flux flow induces secondary currents to flow in the secondary structures 162 and 163. The primary winding has input terminals 170 and 171. Also shown in dashed lines is a third secondary configuration 165 which essentially is the secondary configuration, as shown in FIGS. 7 and 8.

Figure 15:
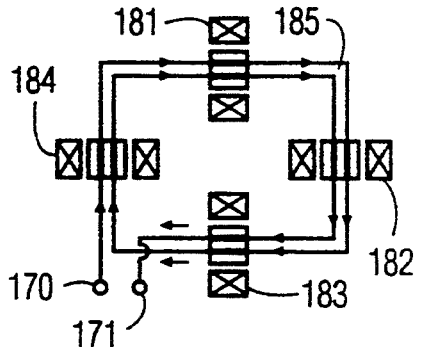
FIG. 15 is a schematic of a transformer configuration according to FIG. 14.

FIG. 15 shows the primary winding 180 with output terminals 171 and 170 in a schematic form which primary winding is now surrounded by secondary windings as 181, 182, 183 and 184. Shown in FIG. 15 are four secondary windings each of which may have a configuration shown in FIG. 7 or the configuration shown in FIG. 8. It is seen that current flowing in the primary winding, which consists of four cylinders, connected together as described, induces current in the secondary windings as shown in FIG. 15.

Figure 16:
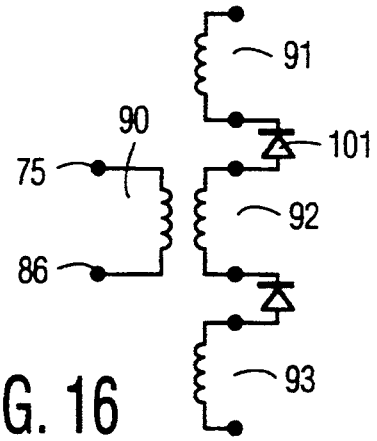
FIG. 16 is a circuit diagram depicting an equivalent circuit for the transformer configuration shown in FIG. 7.

Referring to FIG. 16, there is shown a circuit configuration of the transformer arrangement shown in FIG. 7. As seen, the transformer consists of a primary winding having input terminals 75 and 86. The primary. winding 90 is implemented by means of the central cylinder 70 and the outer cylinder 79 of FIG. 7. There are a plurality of secondary windings as windings 91, 92 and 93, each of which is formed from a separate, concentric, lamina sheet such as sheets 71, 72, 73 and so on of FIG. 7. Each of the separate secondary windings as indicated have two terminals and can be interconnected by means of diodes or rectifiers, such as 101, shown connecting one terminal of secondary winding 92 to one terminal of secondary winding 91.

Figure 17:
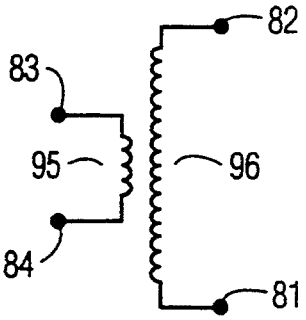
FIG. 17 is a circuit diagram depicting the circuit configuration utilized for the transformer configuration shown in FIG. 8.

Referring to FIG. 17, there is shown a schematic diagram depicting a circuit configuration of the transformer arrangement shown in FIG. 8. As seen, the primary winding 95 has input terminals 83 and 84 and is associated with a large secondary winding 96 having terminals 81 and 82, which winding 96 consists of the spiral winding having many turns and therefore is capable of extremely high voltage step-up ratios.

As one can ascertain from FIGS. 7 and 8, the transformer shown utilize rolled flexible planar sheets, essentially are rolled up employing similar techniques used in forming capacitors. Such transformers are extremely reliable and possess many features which are not found in conventional transformers. The transformers exhibit a higher efficiency in the range of 95% or greater and exhibit extremely good voltage regulation of about 0.97 Mohms. These transformers have high frequency responses to 100 kHz. The transformers have extremely good efficiency and a very optimum usage of transformer materials based on their construction. As one will understand, a secondary core is fabricated with a number of concentric and telescoping thin annular rings, as for example shown in FIG. 7. Each of the rings is capable of accommodating a maximum number of current carrying conductors, such as 11 and 13 of FIG. 1. Thus the core material which is evidenced by planar member 12 of FIG. 1 is fully and most efficiently excited. The result is a much higher attainable voltage than can be realized with a single prior art core with one winding.

It is also indicated that the planar sheets are folded in an annular or concentric ring patterns with an input terminal, as for example 31, providing one terminal of a secondary winding and the output terminal 35 providing the second output terminal. As indicated, these windings can be directly connected together to form a single secondary winding or can be connected by means of rectifiers. For a given primary excitation with a single prior art secondary core and winding, the optimum ratio of the two radii for the higher secondary voltage is 1.6487. At the same ratio, the attainable secondary voltage with a secondary core comprised of a given number of concentric planar sheets, as for example shown in FIG. 7, is 1.718 times higher. The available secondary voltage from the improved devices is three or four times higher than that obtained with conventional transformers.

Improved operation is also due to the fact that the current excitation is provided via the wireless tapes or planar members which have evaporated conductors on the surface and which closely couple to the central magnetic sheet or magnetic member resulting in practically no local leakage for the transformer. Thus the transformer, while being extremely efficient, is extremely small considering the voltage levels operated on.

I claim:

1. A transformer secondary winding comprising:

a flexible laminated member, comprising a first planar sheet member having a first plurality of parallel conductive lines on a surface thereof, a second planar sheet member having a second plurality of parallel conductive lines of a surface thereof, a central planar sheet member fabricated from a magnetizable material interposed between said first and second planar members; and connecting means for connecting ends of said first and second parallel lines to one another to form a coiled pattern directed about said central member to enable any current flowing in said coiled pattern to magnetize said central planar sheet according to said current flow, said connecting means comprise cap structures adapted to couple to respective sides of said flexible laminated member, whereby said ends of said first and second parallel lines are connected to one another, said first, second and central planar sheet and said connecting means forming a composite flexible member, said composite flexible member being manipulable into various transformer configurations.

2. The transformer secondary winding according to claim 1 wherein said first sheet is fabricated from a flexible insulative material having said first plurality of conductive lines on a surface thereof.

3. The transformer secondary winding according to claim 1 wherein said second sheet is fabricated from a flexible insulative material having said second plurality of conductive lines on a surface thereof.

4. The transformer secondary winding according to claim 1 wherein said first and second sheets are fabricated from paper.

5. The transformer secondary winding according to claim 1 wherein said central planar sheet is fabricated from a soft iron.

6. The transformer secondary winding according to claim 1 wherein said first plurality of parallel lines are each at an angle with respect to the vertical and with said second plurality of lines at a different angle to form a zig-zag coiled pattern.

7. The transformer secondary winding according to claim 1 wherein said laminated member is arranged in a circle to form a cylindrical transformer secondary winding.

8. A transformer apparatus, comprising:

an inner primary structure of a first flexible sheet having a plurality of parallel primary conductive lines disposed on a surface, said sheet flexed to form a first primary cylinder, at least one secondary winding of a flexible laminated member comprising first and second insulator sheets separated by a third magnetizable sheet, with said first sheet having a first plurality of conductive lines on a surface thereof and with said second sheet having a second plurality of conductive lines on a surface thereof, with the ends of said first lines connected to ends of said second lines to form an alternating line pattern between said first and second sheets to surround said magnetizable sheet with a coiled conductive pattern, said flexible laminated member arranged in a circular configuration concentrically about said first primary cylinder;

an outer primary structure of a second flexible sheet having a second plurality of parallel primary conductive lines disposed on a surface, said second flexible sheet concentrically surrounding said secondary winding; and means for connecting selected ends of said first primary conductive lines to selected ends of said second primary conductive lines to form a primary winding disposed about said secondary winding to enable current flowing in said primary winding to induce current flow in said secondary winding.

9. The apparatus according to claim 8 further including another secondary winding of flexible laminated member arranged as said least one laminated member and concentrically surrounding said at least one secondary winding to form another secondary winding with said another winding positioned between said at least one secondary winding and said outer primary winding.

10. The apparatus according to claim 9 including rectifier means coupling said one secondary winding to said another secondary winding.

11. The apparatus according to claim 9 wherein said flexible insulator sheets are fabricated from paper.

12. The apparatus according to claim 9 wherein said magnetizable sheets are fabricated from a soft iron.

13. The apparatus according to claim 9 wherein each of said lines on said first sheet are at a given angle with respect to the vertical, with each of said lines on said second sheet at another angle with respect to the vertical to enable said lines to form a zig-zag coiled pattern when the ends are connected.

14. The apparatus according to claim 13 wherein said sheets are each about 1 mil thick.

15. The apparatus according to claim 8 wherein said means for connecting selected ends of said first primary conductive lines to selective ends of said second primary conductive lines comprises first and second cap member ends having a radial line pattern disposed on a surface and with said top member operative to connect the top terminal of a conductive line on said inner primary winding to the top terminal of a conductive line on said outer primary structure, and with said bottom member operative to connect selected bottom terminals of conductive lines on said inner and outer primary structures to provide said primary coil winding due to said connections.

16. The transformer according to claim 8 wherein said at least one secondary winding is coiled to assume a spiral configuration.

17. A transformer apparatus comprising:

first and second flexible primary sheets, each having a plurality of parallel conductive lines disposed on a surface, and each flexed to form a cylinder, with a first cylinder spaced apart from a second cylinder, each of said lines having a top terminal and a bottom terminal;

means for interconnecting top and bottom terminals of said conductive lines of said first cylinder with top terminals of conductive lines of said second cylinder to form a coiled primary winding between said first and second cylinders;

at least one first secondary winding of a flexible laminated member comprising first and second insulator sheets separated by a magnetizable sheet, with said first sheet having a first plurality of conductive lines on a surface thereof and with said second sheet having a second plurality of conductive lines on a surface thereof, with the ends of said first lines connected to ends of said second lines to form an alternating line pattern between said first and second sheets to surround said another magnetizable sheet with a coiled conductive pattern, with said flexible laminate member arranged in a circular configuration which concentrically surrounds said first primary cylinder;

at least one second secondary winding of a flexible laminated member comprising third and fourth insulator sheets separated by another magnetizable sheet, with said third sheet having a third plurality of conductive lines on a surface thereof and with said fourth sheet having a fourth plurality of conductive lines on a surface thereof, with the ends of said third lines connected to ends of said fourth lines to form an alternating line pattern between said third and fourth sheets to surround said another magnetizable sheet with a coiled conductive pattern, with said flexible laminate member arranged in a circular configuration which concentrically surrounds said second primary cylinder whereby current flowing in said primary winding induces current flow in said first and second secondary windings.

18. The transformer apparatus according to claim 17 wherein said flexible primary sheets are insulative sheets.

19. The transformer apparatus according to claim 17 wherein said magnetizable sheets are soft iron sheets.

20. The transformer according to claim 18 wherein said flexible primary sheets are fabricated from paper.

21. The transformer apparatus of claim 1, wherein said first and second plurality of conductive lines terminate in land areas disposed on top and bottom surfaces of said first and second planar sheets, said cap structure including contact regions adapted to coact with said land areas.

* * * * *